United States Patent [19]

Barlow et al.

[11] Patent Number: 4,504,243

[45] **Date of Patent: * Mar. 12, 1985**

[54] EDUCATIONAL TOY WITH PATH CREATING TILES FOR A VEHICLE

[75] Inventors: Gordon A. Barlow; John R. Krutsch, both of Glenview, Ill.

[73] Assignee: Gordon Barlow Design, Skokie, Ill.

[ * ] Notice: The portion of the term of this patent subsequent to Aug. 31, 1999 has been disclaimed.

[21] Appl. No.: 455,412

[22] Filed: Jan. 3, 1983

[51] Int. Cl.[3] ..... A63H 19/28

[52] U.S. Cl. ..... 446/447; 446/444

[58] Field of Search ..... 446/85, 102, 429, 444, 446/445, 446, 447; 273/1 GA, 1 GE, 109, 153 S

[56] References Cited

U.S. PATENT DOCUMENTS

| | | | |
|---|---|---|---|
| 3,074,200 | 1/1963 | Ziegenfuss | 46/1 |
| 3,402,503 | 9/1968 | Glass et al. | 46/17 |
| 3,414,194 | 12/1968 | Seitzinger et al. | 238/10 |
| 3,494,617 | 2/1970 | Glass et al. | 273/1 |
| 3,690,031 | 9/1972 | Shinoda | 46/17 |
| 4,146,991 | 4/1979 | Sand | 46/1 K |
| 4,346,889 | 8/1982 | Barlow et al. | 273/1 GA |

*Primary Examiner*—Mickey Yu

*Attorney, Agent, or Firm*—Kinzer, Plyer, Dorn & McEachron

[57] ABSTRACT

An educational toy for a child. The toy includes a rectangular frame surrounding a rectangular center area. Tiles are positioned in the center area to fill this area except for one vacant space equal in size to a tile. A pair of grooves are formed in the top surface of each tile with each groove extending from one side edge of a tile to another side edge of a tile with all grooves intersecting the side edges of its tile at the midpoint of each side edge. Some tiles have only straight grooves which intersect while other tiles have only arcuate curves which do not intersect. Turnaround grooves are formed in the rectangular frame. Each turnaround groove opens at its opposite ends into the center area of the frame. The ends of the turnaround grooves are spaced from each other and positioned relative to the sides of the rectangular center area so that the grooves of the tiles can be aligned with the turnaround grooves to form a continuous vehicle path from the tiles onto the rectangular frame and then back onto the tiles. A vehicle is provided to move across the tiles and frame. The vehicle has a pair of guides which extend into the grooves to direct the vehicle along a selected path. A drive axle with a pair of drive wheels is located between the guides. A differential effect to enable the vehicle to transverse curves in the grooves is provided by the drive wheel construction and raised portions on the tiles and frame.

4 Claims, 9 Drawing Figures

11
27
19
21
4
41
43
45
71
77
65
63
73
67
79
23
69
33
13
25
29
31
14
15
17

49
15
61
59
53
51
55
57

49
15
61
59
53
51
57

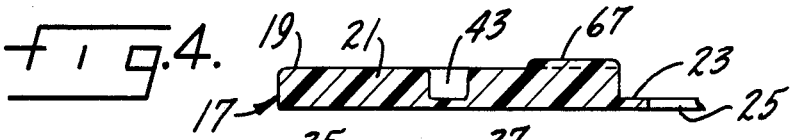
fig.4.
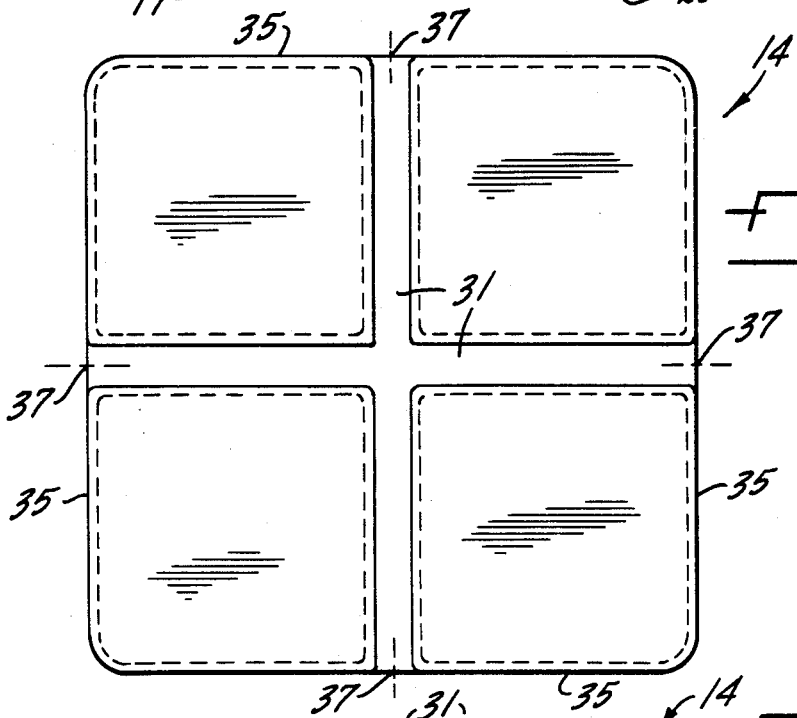
fig.5.
fig.6.
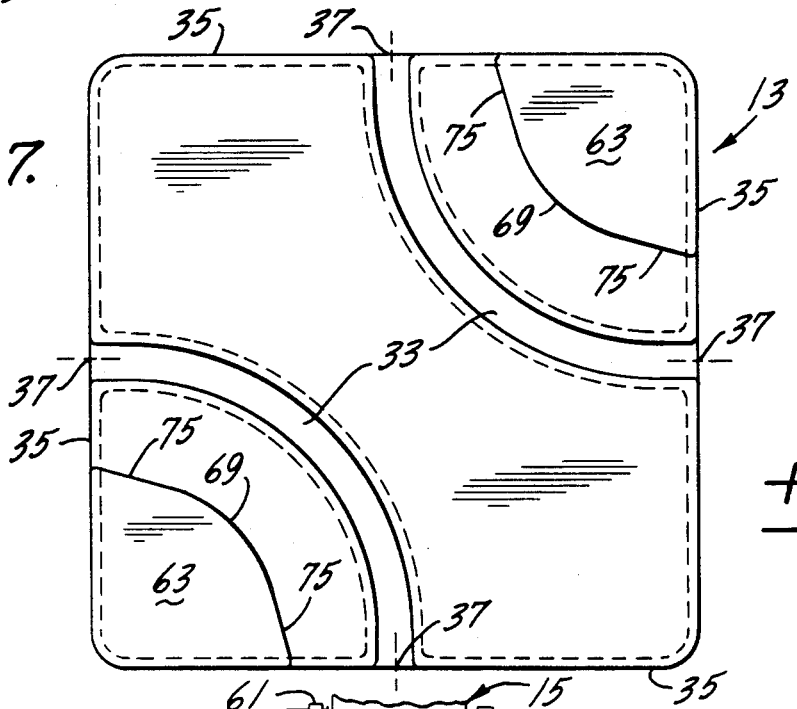
fig.7.
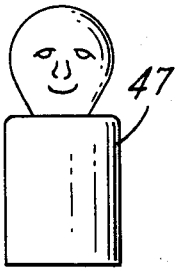
fig.9.
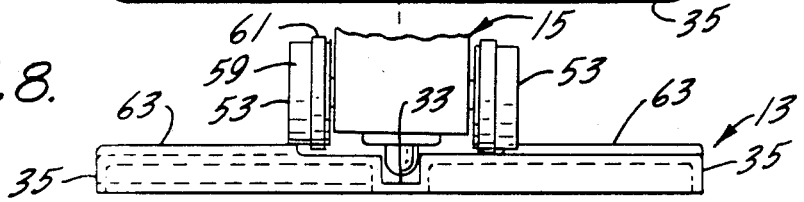
fig.8.

EDUCATIONAL TOY WITH PATH CREATING TILES FOR A VEHICLE

SUMMARY OF THE INVENTION

This invention is concerned with a child's educational toy which enables a child to learn to create a continuous path for a vehicle by moving tiles within a framework, each tile containing only a portion of a path for the vehicle.

A controlled environment is provided by a frame encompassing a center area where the tiles can be manipulated by the child by sliding the tiles. The number of tiles provided is one less than the area of the center area so that a vacant space the size of a tile is provided. This permits the tiles to be moved by sliding rather than lifting. Each tile has a pair of grooves extending across the face of the tile. The grooves can either be arcuate and non-intersecting or straight and intersecting. To provide a continuous path, turnaround grooves are also formed in the frame and the ends of these turnaround grooves are always located so that they can be aligned with the grooves on the tiles by moving the tiles to the proper positions.

The vehicle which is operated by the child has a pair of guides which fit into the grooves to control the path of movement of the vehicle. The vehicle is able to navigate the arcuate grooves in the tiles and the turnaround grooves on the frame because of its unique drive wheels which coact with raised areas on the tiles and frame to provide a differential effect for the drive wheels. The vehicle is constructed so that it can carry toy replicas of passengers. Illustrations representing home, zoo, school, etc. can be applied to the frame so that the child can use the game to fantasize a city bus route or a school bus route. If the tiles are not properly arranged by the child, the child will not be able to direct the bus along a continuous path from one location to another.

Other purposes and uses of the invention will be found in the following specification and drawings.

BRIEF DESCRIPTION OF THE DRAWINGS

The invention is illustrated more or less diagrammatically in the following drawings wherein:

FIG. 4 is an enlarged cross sectional view of the frame taken along line 4—4 of FIG. 1;

FIG. 5 is an enlarged top plan view of one form of tile;

FIG. 6 is a side elevational view of the tile of FIG. 5 with a portion broken away;

FIG. 7 is a top plan view of another form of tile on an enlarged scale;

FIG. 8 is a side elevational view of the tile of FIG. 7 showing a vehicle partially broken away rounding the curved groove; and FIG. 9 is a front elevational view on an enlarged scale of a replica of a passenger to be carried by the vehicle of FIGS. 2 and 3.

DESCRIPTION OF THE PREFERRED EMBODIMENT

Figure 1:
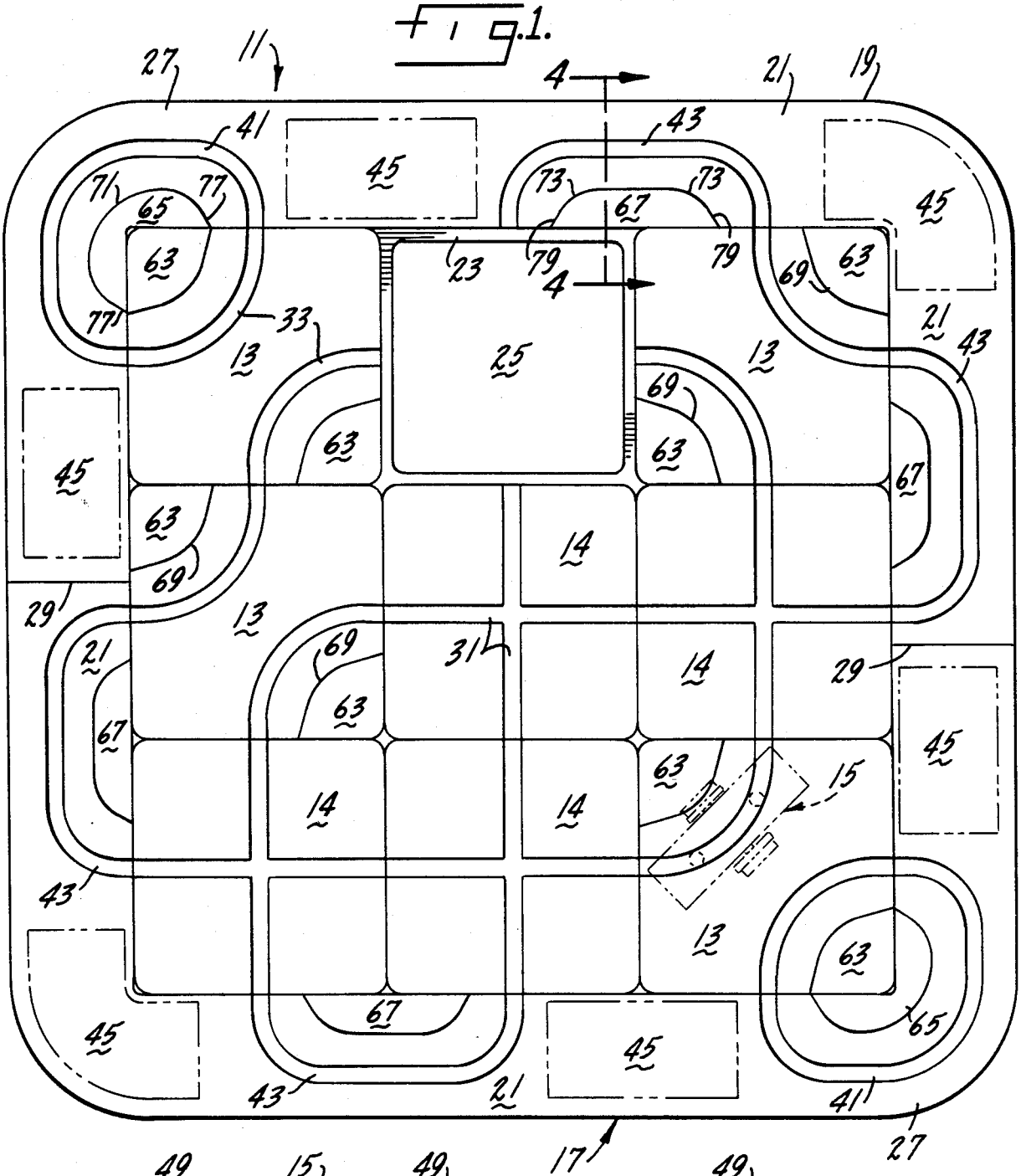
FIG. 1 is a top plan view of the toy of this invention with the vehicle shown in phantom lines rounding one of the curved grooves.
Figure 2:
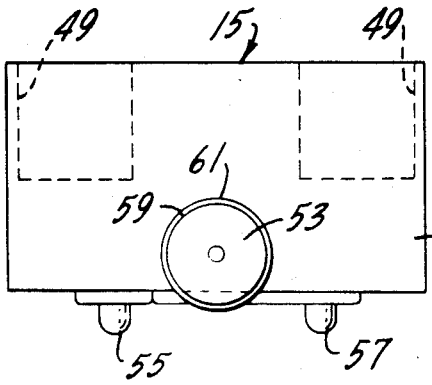
FIG. 2 is a side elevational view of the vehicle shown in FIG. 1 on an enlarged scale.
Figure 3:
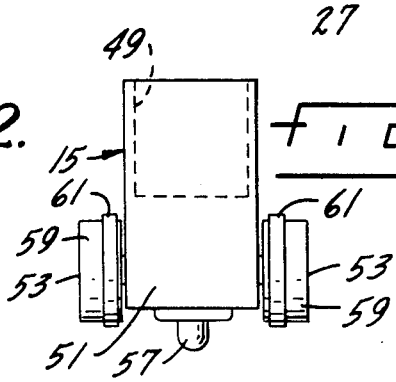
FIG. 3 is an end view of the vehicle of FIG. 2.

The child's educational toy 11 of this invention is shown in the drawings. It includes tiles 13 and 14, a self-propelled vehicle in the form of a bus 15 and a base 17 on which the tiles are supported for sliding movement. The base includes an outer frame 19 formed by four relatively wide peripheral walls 21. The frame surrounds a rectangular central area 23 of the base which is used to support the tiles. In this example, the central area and the entire base are square although they may also be rectangular. To reduce the weight of the base and to reduce the cost by using a minimal amount of plastic in forming the base, rectangular openings 25 are formed in the central area 23 of the base. Each of the rectangular openings 25 is smaller in at least one direction than a tile so that the tiles will be supported on the central area of the base.

In this embodiment of the invention, eight tiles 13 and 14 are provided with each tile being a square. Each tile is molded of plastic, has thin walls and is of inverted cup-shaped configuration. The central area 23 of the base is also in the form of a square sufficiently large to hold nine tiles. For ease of manufacture, the base may be formed in sections of non-rectangular shape, preferably two identical sections 27 which snap fasten to one another by means of integral projections and recesses which are conventional and are not shown. The sections 27 fit together to form the square base 17 along an offset center line 29.

A pair of grooves are formed in each tile. On tiles 14, a pair of straight grooves 31 are formed with the grooves crossing each other in the middle of the tile. On tiles 13, a pair of curved grooves 33 are formed which grooves do not intersect each other. Each groove, whether straight or curved, intersects a side edge 35 of its tile at the midpoint 37 thereof. In the embodiment of the invention shown in the drawings, four of the tiles 13 have a pair of curved grooves 33 which curves open toward opposite corner edges of the tile and do not intersect. Four of the tiles 14 have two straight grooves 31 which extend at right angles to each other to form a cross on the tile. Of course, it should be understood and appreciated that other combinations of curved and crossed grooved tiles may be used.

Turnaround grooves 41 and 43 are formed on the frame 19 with the opposite ends of the turnaround grooves opening into the central area 23 of the base. A turnaround groove 41 is formed at each of one set of the opposite diagonally located corners of the frame. Each of these grooves provides a turnaround of 270°. Another turnaround groove 43 is located on each wall 21 of the frame between the corners. Each of the grooves 43 forms a turnaround of 180°. On each side of the frame, one of the turnaround grooves 43 will align with the grooves of a pair of side-by-side tiles and a turnaround groove 41 at a corner will align with one curved groove or a pair of crossed grooves of a single tile when the tiles are properly aligned against the walls 21 defining the central area of the base. The turnaround grooves permit a child playing with the toy to form a continuous path from the tiles 13 and 14 onto the frame 19 and back onto the tiles 13 and 14.

Indicia 45 in the form of illustrations may be applied to the frame 19 between the grooves 41 and 43. In the embodiment of the toy shown in the drawings, the indicia 45 may indicate a school, a home, a zoo, a candy store, a fast food restaurant and a bus depot although, of course, other illustrations may also be used. A toy replica 47 representing a passenger is shown in FIG. 9 of the drawings. The toy replica 47 is sized so that it can snugly fit into one of the cylindrical sockets 49 formed in the vehicle housing 51.

The self-propelled vehicle 15 includes the housing 51 which is molded so as to have the appearance of an old-fashioned bus. The housing encloses batteries and an electric motor which drives the bus through a conventional gear arrangement attached to an axle having a pair of drive wheels 53, the illustration of which, except for the drive wheels, has been eliminated for clarity. A pair of guide pins 55 and 57 are attached to the bottom of the housing 51 and are positioned to ride in the grooves 31, 33, 41 and 43 formed in the tiles 13 and 14 and frame 19. The drive wheels are located between the guide pins 55 and 57 which balance the vehicle. Each drive wheel 53 includes a wheel housing 59 having a tire 61 mounted thereon. The wheel housing, which extends outwardly beyond the tire, is formed of plastic which has a much lower coefficient of friction than the material of the tire.

Each of the curved grooves 33 formed on a tile 13 has a raised curb 63 located on the inside of the curve of the groove, that is, between the curved groove and the corner of the tile. Also, each of the turnaround grooves 41 and 43 has a raised curb 65 and 67, respectively, on the inside of the curve of its groove. Each curb has a height slightly greater than the difference between the radius of the tire 61 and the radius of the wheel housing 59 so that the vehicle tire 61 on the inside of the curved groove is lifted from engagement with the tile or frame while the vehicle tire 61 on the outside of the curve continues to drive the vehicle thereby providing a differential effect for the drive axle of the vehicle.

The curbs 63, 65 and 67 have curved side walls 69, 71 and 73, respectively, facing their respective curved grooves 33, 41 and 43. However, the curves of the side walls are not identical to the curves of their grooves. The side walls of the curbs have been straightened where they meet the edges of the tiles and the frame so that the curb is closer to its groove that it would have been had the curb the same shape as its groove. The wheel housing 59 of the vehicle is raised by these straight portions of the curbs as the vehicle enters and leaves the curved and turnaround grooves. The straight portions 75 of the curb 63 on the tile 13 forms an angle of approximately 15° with the sides of the tile. The straight portions 77 and 79 of the curbs 65 and 67 of the turnaround grooves each forms an angle of approximately 30° with the edge of the frame 19.

The child using this toy must arrange the tiles so as to create a continuous path between the various indicia 45 applied to the frame 19. This is accomplished by sliding the tiles 13 or 14 so that the straight grooves 31 and curved grooves 33 on adjacent tiles form a continuous path with the turnaround grooves 41 and 43 formed on the frame. As the self-propelled vehicle 15 moves along the defined path, the child can change the path followed by the vehicle by moving the tiles. The vehicle can continue to move without stopping as long as it has a continuous path. Thus, the imagination and mechanical dexterity of the child are challenged.

We claim:

1. An educational toy for a child including:

a rectangular frame surrounding a rectangular center area, a plurality of generally similar rectangular tiles slidable relative to one another in the center area to fill the center area except for one vacant space equal in size to a tile, a pair of grooves formed in the top surface of each of the tiles with each groove extending from one side edge of a tile to another side edge of a tile with all grooves intersecting the side edges of its tile at the midpoint of each side edge so that continuous paths can be formed on adjacent tiles, turnaround grooves formed in the rectangular frame with each turnaround groove opening at its opposite ends into the rectangular center area of the frame with the ends of the arcuate groove spaced from each other and positioned so that the grooves of the tiles can be aligned with the turnaround grooves to form a continuous vehicle path from the tiles onto the rectangular frame and then back onto the tiles, and a vehicle adapted to move across the tiles and frame, said vehicle having a guide means which rides in the grooves to guide the vehicle along a path defined by the grooves as it moves across the tiles and frame.

2. The educational toy of claim 1 in which turnaround grooves are formed at diagonally opposite corners of the rectangular frame, each corner groove has opposite ends that open into the rectangular center area of the frame on opposite sides of its corner.

3. The educational toy of claim 1 in which turnaround grooves are formed in the rectangular frame between the corners, each such groove having opposite ends that open into the rectangular center area between the corners.

4. The educational toy of claim 1 in which:

curved grooves are formed on some of the tiles, raised curbs are formed on the insides of the curved grooves, raised curbs are also formed on the insides of the turnaround grooves, the vehicle has a single drive axle with two wheels, each wheel includes a housing and a tire mounted thereon with the housing extending outwardly beyond the tire, the housing extending outwardly beyond the tire engaging the curb to lift the tire out of engagement with the tile or frame to provide a differential effect for the drive axle as the vehicle traverses a curved or turnaround groove.

* * * * *